US012660863B2

(12) United States Patent
Lee et al.

(10) Patent No.: US 12,660,863 B2
(45) Date of Patent: Jun. 23, 2026

(54) AEROSOL GENERATING MODULE AND AEROSOL GENERATING DEVICE

(71) Applicant: KT&G CORPORATION, Daejeon (KR)

(72) Inventors: Wonkyeong Lee, Guri-si (KR); Min Kyu Kim, Seoul (KR); Paul Joon Sunwoo, Seoul (KR)

(73) Assignee: KT&G Corporation, Daejeon (KR)

( * ) Notice: Subject to any disclaimer, the term of this patent is extended or adjusted under 35 U.S.C. 154(b) by 384 days.

(21) Appl. No.: 18/276,742

(22) PCT Filed: May 11, 2023

(86) PCT No.: PCT/KR2023/006400
§ 371 (c)(1),
(2) Date: Aug. 10, 2023

(87) PCT Pub. No.: WO2023/229266
PCT Pub. Date: Nov. 30, 2023

(65) Prior Publication Data

US 2025/0017275 A1 Jan. 16, 2025

(30) Foreign Application Priority Data

May 23, 2022 (KR) ..... 10-2022-0062698

(51) Int. Cl.
*A24F 42/10* (2020.01)

(52) U.S. Cl.
CPC ..... *A24F 42/10* (2020.01)

(58) Field of Classification Search
CPC ..... A24F 42/10
See application file for complete search history.

(56) References Cited

U.S. PATENT DOCUMENTS

| | | | | |
|---|---|---|---|---|
| 2015/0217064 | A1 | 8/2015 | Trzecieski | |
| 2015/0223520 | A1* | 8/2015 | Phillips | A61M 11/047 131/328 |
| 2018/0092399 | A1* | 4/2018 | Kieslich | A61M 15/06 |
| 2020/0037662 | A1 | 2/2020 | Richmond et al. | |

FOREIGN PATENT DOCUMENTS

| | | | |
|---|---|---|---|
| CN | 113412963 | A | 9/2021 |
| JP | 2019-535242 | A | 12/2019 |
| KR | 10-2019-0078638 | A | 7/2019 |
| WO | 2014/140087 | A1 | 9/2014 |

OTHER PUBLICATIONS

Japanese Office Action on Appl. No. 2023-579579 dated Jan. 7, 2025.
Translation of the International Search Report issued Aug. 11, 2023 in International Application No. PCT/KR/2023/006400.

* cited by examiner

*Primary Examiner* — Robert C Dye
(74) *Attorney, Agent, or Firm* — Foley & Lardner LLP

(57) ABSTRACT

An aerosol generating module according to various embodiments includes a heating unit and an atomizing unit disposed adjacent to the heating unit and including an aerosol forming substrate, wherein the heating unit includes a first reservoir including a first material, a second reservoir including a second material that generates heat by reacting with the first material, and a barrier plate disposed between the first reservoir and the second reservoir and formed of an impermeable material, and the aerosol forming substrate is heated by heat generated by mixing the first material and the second material.

11 Claims, 4 Drawing Sheets

[Fig. 1]
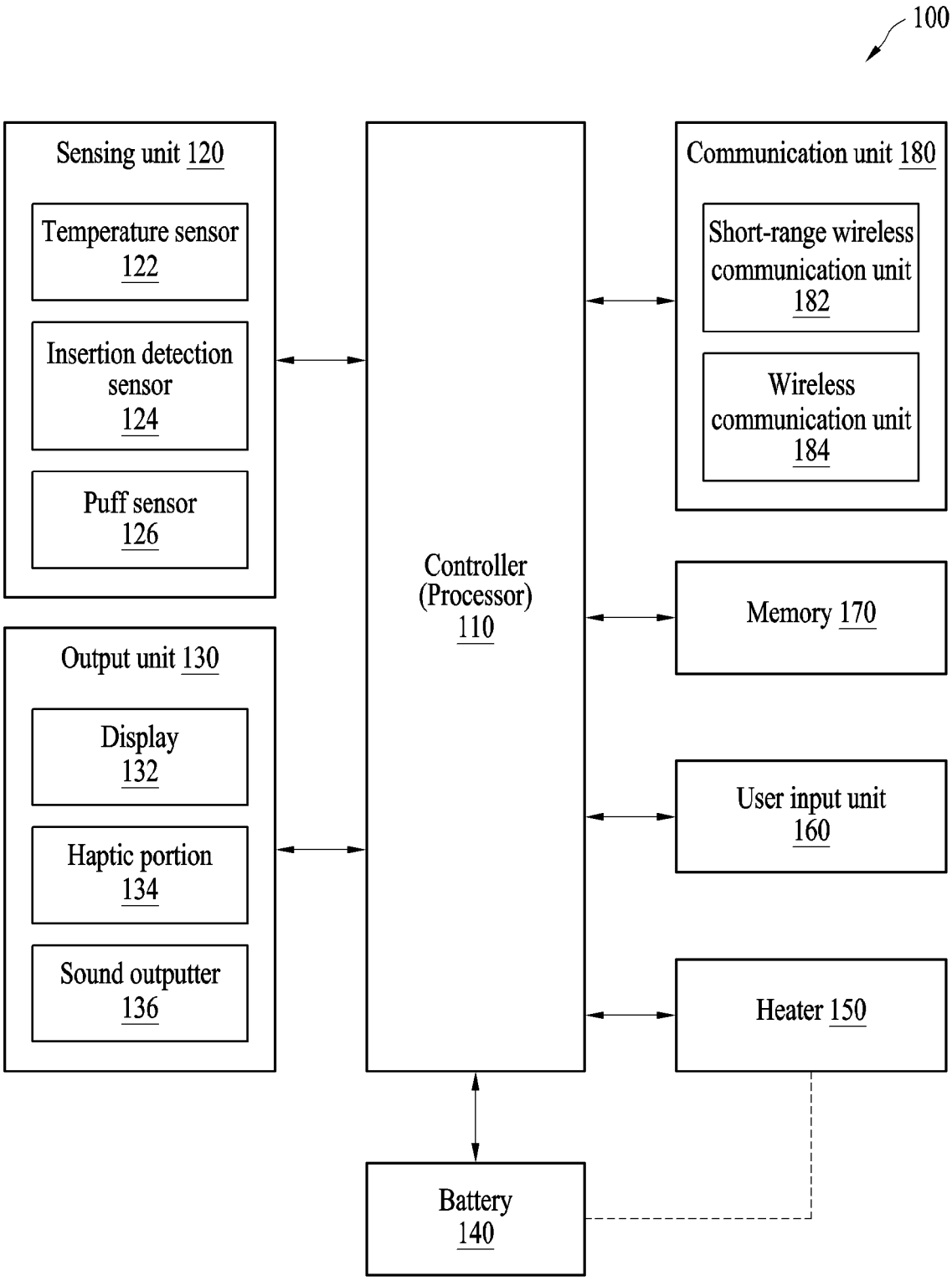

[Fig. 2]
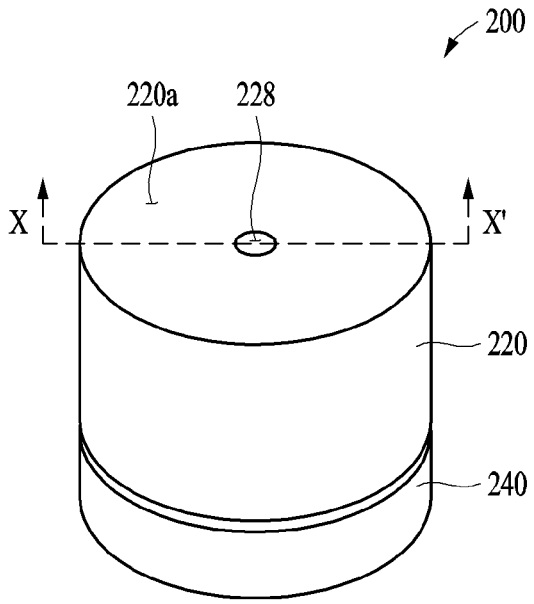
[Fig. 3a]
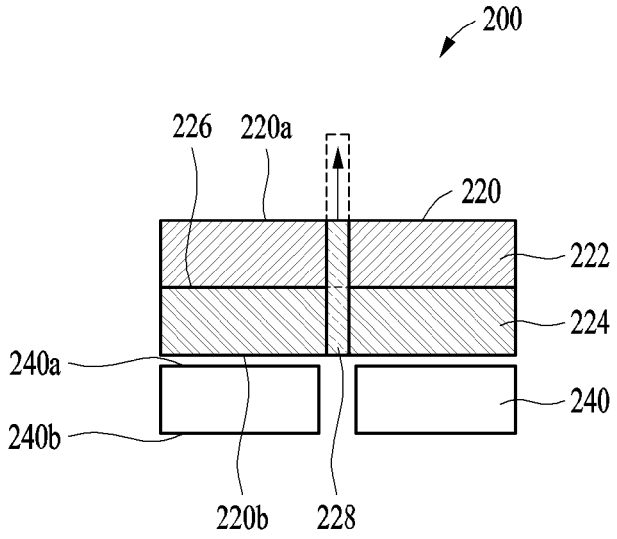

[Fig. 3b]
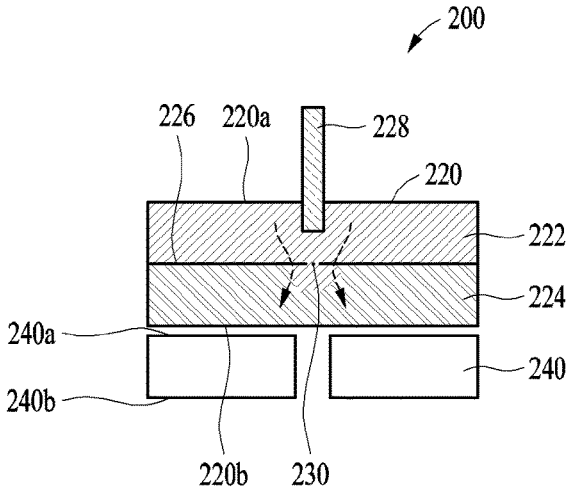
[Fig. 3c]
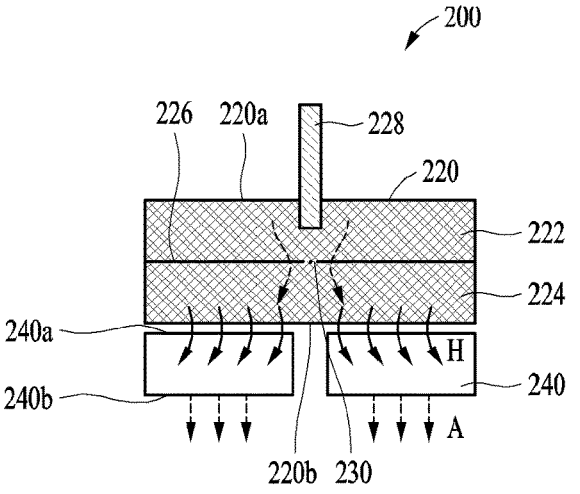
[Fig. 4]
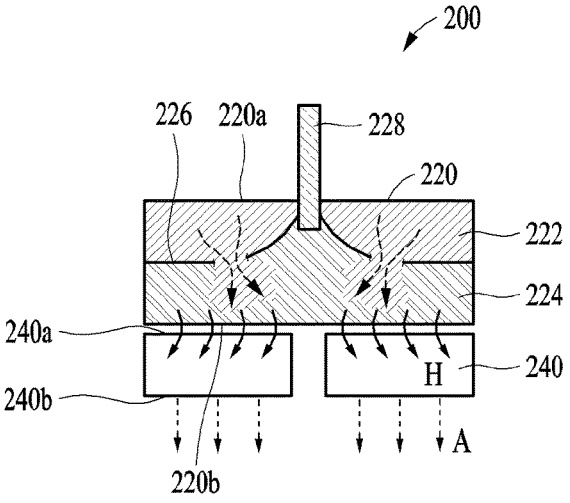

[Fig. 5]
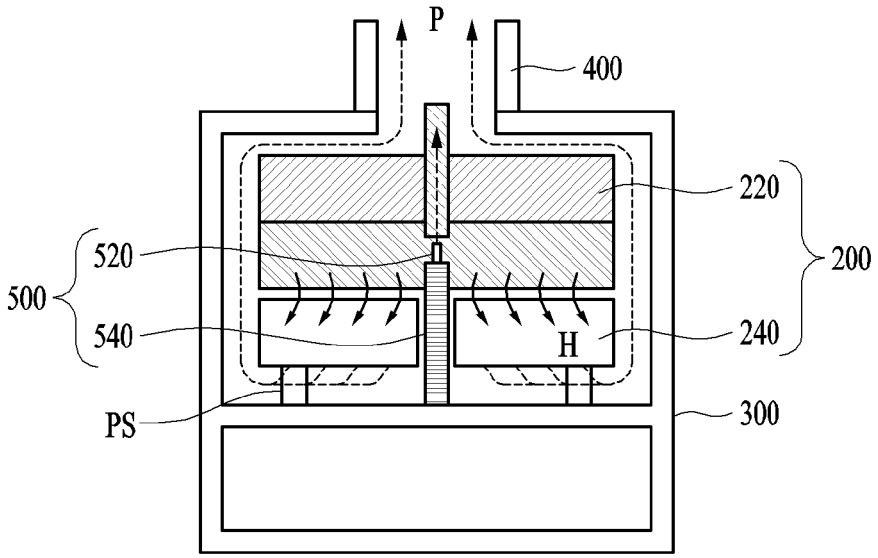
[Fig. 6]
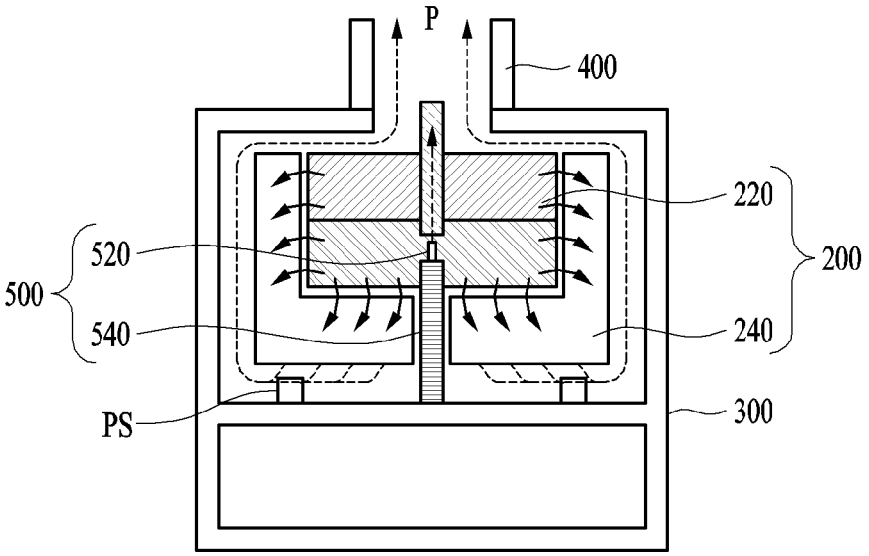

AEROSOL GENERATING MODULE AND AEROSOL GENERATING DEVICE

CROSS REFERENCE TO RELATED APPLICATIONS

This application is a National Stage of International Application No. PCI/KR2023/006400 filed May 11, 2023, claiming priority based on Korean Patent Application No. 10-2022-0062698 filed May 23, 2022.

TECHNICAL FIELD

The following embodiments relate to an aerosol generating module and an aerosol generating device.

Background Art

Recently, demands for alternative ways to overcome disadvantages of general cigarettes have increased. For example, there is an increasing demand for a device (e.g., an electrically heated tobacco product) that generates an aerosol by electrically heating a cigarette stick. Accordingly, research on an electrically heated aerosol generating device and a cigarette stick (or an aerosol generating article) applied thereto is being actively conducted. For example, Korean Patent Publication No. 10-2017-0132823 discloses a non-combustion-type flavor inhaler, a flavor inhalation component source unit, and an atomizing unit.

DISCLOSURE OF INVENTION

Technical Problem

An embodiment provides an aerosol generating module and an aerosol generating device that may minimize power consumption by generating an aerosol using a heating unit that requires no power.

An embodiment provides an aerosol generating device that improves portability by generating an aerosol using a heating unit that requires no power and battery.

Solution to Problem

According to various embodiments, an aerosol generating module may include a heating unit and an atomizing unit disposed adjacent to the heating unit and including an aerosol forming substrate, wherein the heating unit may include a first reservoir including a first material, a second reservoir including a second material that generates heat by reacting with the first material, and a barrier plate disposed between the first reservoir and the second reservoir and formed of an impermeable material, and the aerosol forming substrate may be heated by heat generated by mixing the first material and the second material.

In an embodiment, the heating unit may further include a first wall, a second wall disposed opposite to the first wall and disposed adjacent to the atomizing unit, and a barrier stick penetrating between the first wall and the second wall of the heating unit, and the barrier stick may move in a direction perpendicular to the first wall of the heating unit.

In an embodiment, the barrier plate may include a through-hole having a diameter corresponding to a diameter of the barrier stick, and when the barrier stick is pushed from the second wall toward the first wall, the first material and the second material may be mixed through the through-hole.

In an embodiment, the barrier plate may be formed of a material having less tensile strength than the barrier stick, the barrier plate and the barrier stick are integrally formed, and when the barrier stick is pushed from the second wall toward the first wall, the barrier plate may be ruptured, and thus the first material and the second material may be mixed.

In an embodiment, the atomizing unit may discharge an aerosol from at least one of surfaces except for a surface adjacent to the heating unit.

According to various embodiments, an aerosol generating device may include a housing, a mouthpiece formed at one end of the housing, and an aerosol generating module included in the housing, wherein the aerosol generating module may include an atomizing unit configured to store an aerosol forming substrate and a heating unit disposed adjacent to the atomizing unit and configured to heat the aerosol forming substrate, the heating unit may include a first reservoir including a first material, a second reservoir including a second material that generates heat by reacting with the first material, and a barrier plate disposed between the first reservoir and the second reservoir and formed of an impermeable material, and the aerosol forming substrate may be heated by heat generated by mixing the first material and the second material.

In an embodiment, the heating unit may further include a first wall facing the mouthpiece, a second wall disposed opposite to the first wall, and a barrier stick penetrating between the first wall and the second wall of the heating unit, wherein the aerosol generating device may further include a push unit configured to push the barrier stick.

In an embodiment, the barrier plate may include a through-hole having a diameter corresponding to a diameter of the barrier stick, and when the aerosol generating module is inserted into the housing, the push unit pushes the barrier stick from the second wall toward the first wall and thus, the first material and the second material may be mixed through the through-hole.

In an embodiment, a diameter of the push unit may be smaller than a diameter of the through-hole.

In an embodiment, the barrier plate may be formed of a material having less tensile strength than the barrier stick, the barrier plate and the barrier stick are integrally formed, and when the aerosol generating module is inserted into the housing, the push unit pushes the barrier stick from the second wall toward the first wall, and thus, the barrier plate is ruptured, and the first material and the second material may be mixed.

In an embodiment, the push unit may be exposed from a surface of an interior of the housing by a user input.

In an embodiment, the atomizing unit may discharge an aerosol through an atomizing surface including at least one of surfaces except for a surface disposed adjacent to the heating unit, and the aerosol generated in the atomizing unit may move to the mouthpiece through an airflow path formed along an inner wall of the housing.

In an embodiment, the atomizing surface may be formed in a mesh type through which the generated aerosol may pass.

In an embodiment, the heating unit may further include a side wall formed between the first wall and the second wall, and the atomizing unit may be disposed adjacent to at least a portion of the second wall and the side wall.

Advantageous Effects of Invention

An aerosol generating module according to an embodiment may minimize power consumption by generating an aerosol using a heating unit that requires no power.

An aerosol generating device according to an embodiment may improve portability by generating an aerosol using a heating unit that requires no power and battery.

The effects of the aerosol generating module and the aerosol generating device according to an embodiment are not limited to the above-mentioned effects, and other unmentioned effects may be clearly understood from the following description by one of ordinary skill in the art.

BRIEF DESCRIPTION OF DRAWINGS

FIG. 1 is a block diagram of an aerosol generating device according to an embodiment.

FIG. 2 is a schematic diagram of an aerosol generating module according to an embodiment.

FIGS. 3*a* to 3*c* are diagrams schematically illustrating a cross-section of the aerosol generating module of FIG. 2 taken along line X-X'.

FIG. 4 is a diagram schematically illustrating a cross-section of an aerosol generating module according to another embodiment.

FIG. 5 is a diagram schematically illustrating a cross-section of an aerosol generating device according to an embodiment.

FIG. 6 is a diagram schematically illustrating a cross-section of an aerosol generating device according to another embodiment.

MODE FOR THE INVENTION

The terms used to describe the embodiments are selected from among common terms that are currently widely used, in consideration of their function in the disclosure. However, different terms may be used depending on an intention of one of ordinary skill in the art, a precedent, or the advent of new technology. Also, in particular cases, the terms are arbitrarily selected by the applicant of the disclosure, and the meaning of those terms will be described in detail in the corresponding part of the detailed description. Therefore, the terms used to describe the disclosure should be defined based on the meanings of the terms and all the content of the disclosure, rather than the terms themselves.

It will be understood that when a certain part "includes" a certain component, the part does not exclude another component but may further include another component, unless the context clearly dictates otherwise. Also, terms such as "unit," "module," etc., as used in the specification may refer to a part for processing at least one function or operation and which may be implemented as hardware, software, or a combination of hardware and software.

As used herein, an expression such as "at least one of" that precedes listed components modifies not each of the listed components but all the listed components. For example, the expression "at least one of a, b, or c" should be construed as including a, b, c, a and b, a and c, b and c, or a, b, and c.

In the following embodiments, the term "aerosol generating article" may refer to an article that accommodates a medium, in which an aerosol passes through the article and the medium is transferred. A representative example of the aerosol generating article may be a cigarette. However, the scope of the disclosure is not limited thereto.

In the following embodiments, the terms "upstream" or "upstream direction" may refer to a direction away from a mouth of a user (smoker), and the terms "downstream" or "downstream direction" may refer to a direction toward the mouth of the user. The terms "upstream" and "downstream" may be used to describe relative positions of components of the aerosol generating article.

In the following embodiments, the term "puff" refers to inhalation by a user, and inhalation refers to a situation in which a user draws in an aerosol into his or her oral cavity, nasal cavity, or lungs through the mouth or nose.

In an embodiment, an aerosol generating device may be a device that generates an aerosol by electrically heating a cigarette accommodated in an inner space.

The aerosol generating device may include a heater. In an embodiment, the heater may be an electrically resistive heater. For example, the heater may include an electrically conductive track, and the heater may be heated as a current flows through the electrically conductive track.

The heater may include a tubular heating element, a plate-shaped heating element, a needle-shaped heating element, or a rod-shaped heating element, and may heat an interior or exterior of the cigarette according to the shape of a heating element.

The cigarette may include a tobacco rod and a filter rod. The tobacco rod may be formed as a sheet or a strand, or may be formed of tobacco leaves finely cut from a tobacco sheet. In addition, the tobacco rod may be enveloped by a thermally conductive material. For example, the thermally conductive material may be metal foil such as aluminum foil. However, embodiments are not limited thereto.

The filter rod may be a cellulose acetate filter. The filter rod may include at least one segment. For example, the filter rod may include a first segment that cools an aerosol and a second segment that filters a predetermined ingredient contained in the aerosol.

In another embodiment, the aerosol generating device may be a device that generates an aerosol using a cartridge containing an aerosol generating material.

The aerosol generating device may include a cartridge containing the aerosol generating material and a main body supporting the cartridge. The cartridge may be detachably coupled to the main body. However, embodiments are not limited thereto. The cartridge may be integrally formed or assembled with the main body, and may be secured to the main body so as not to be detached by a user. The cartridge may be mounted on the main body while the aerosol generating material is accommodated therein. However, embodiments are not limited thereto. The aerosol generating material may be injected into the cartridge while the cartridge is coupled to the main body.

The cartridge may hold the aerosol generating material in any one of various states, such as a liquid state, a solid state, a gaseous state, and a gel state. The aerosol generating material may include a liquid composition. For example, the liquid composition may be a liquid including a tobacco-containing material having a volatile tobacco flavor ingredient, or a liquid including a non-tobacco material.

The cartridge may be operated by an electrical signal or a wireless signal transmitted from the main body to perform the function of generating an aerosol by converting a phase of the aerosol generating material inside the cartridge to a gaseous phase. The aerosol may refer to a gas in which vaporized particles generated from the aerosol generating material are mixed with air.

In another embodiment, the aerosol generating device may generate an aerosol by heating the liquid composition, and the generated aerosol may pass through the cigarette and be delivered to the user. That is, the aerosol generated from the liquid composition may travel along airflow paths of the aerosol generating device, and the airflow paths may be configured to allow the aerosol to pass through the cigarette and be delivered to the user.

In another embodiment, the aerosol generating device may be a device that generates an aerosol from the aerosol generating material using an ultrasonic vibration manner. In this case, the ultrasonic vibration manner may refer to a manner of generating an aerosol by atomizing the aerosol generating material with ultrasonic vibration generated by a vibrator.

The aerosol generating device may include a vibrator, and may generate vibration at short intervals through the vibrator to atomize the aerosol generating material. The vibration generated by the vibrator may be ultrasonic vibration, and a frequency band of the ultrasonic vibration may be from about 100 kilohertz (kHz) to about 3.5 megahertz (MHz). However, embodiments are not limited thereto.

The aerosol generating device may further include a wick that absorbs the aerosol generating material. For example, the wick may be disposed to surround at least one area of the vibrator or may be disposed to contact at least one area of the vibrator.

As a voltage (e.g., an alternating voltage) is applied to the vibrator, the vibrator may generate heat and/or ultrasonic vibration, and the heat and/or ultrasonic vibration generated by the vibrator may be transmitted to the aerosol generating material absorbed in the wick. The aerosol generating material absorbed in the wick may be converted into a gas phase by the heat and/or ultrasonic vibration transmitted from the vibrator, and consequently, an aerosol may be generated.

For example, the viscosity of the aerosol generating material absorbed in the wick may be lowered by the heat generated by the vibrator, and the aerosol generating material whose viscosity is lowered may change to fine particles by the ultrasonic vibration generated by the vibrator, so that an aerosol may be generated. However, embodiments are not limited thereto.

In another embodiment, the aerosol generating device may be a device that generates an aerosol by heating the aerosol generating article accommodated therein in an induction heating manner.

The aerosol generating device may include a susceptor and a coil. In an embodiment, the coil may apply a magnetic field to the susceptor. As the aerosol generating device supplies power to the coil, a magnetic field may be formed inside the coil. In an embodiment, the susceptor may be a magnetic body that generates heat by an external magnetic field. As the susceptor is positioned inside the coil and generates heat with the magnetic field applied, the aerosol generating article may be heated. Also, optionally, the susceptor may be positioned in the aerosol generating article.

In another embodiment, the aerosol generating device may further include a cradle.

The aerosol generating device and the separate cradle may form a system together. For example, the cradle may be used to charge a battery of the aerosol generating device. Alternatively, a heater may be heated when the cradle and the aerosol generating device are coupled to each other.

Hereinafter, embodiments of the disclosure will be described in detail with reference to the accompanying drawings such that one of ordinary skill in the art may easily practice the disclosure. The disclosure may be practiced in forms that are implementable in the aerosol generating devices according to various embodiments described above or may be embodied and practiced in many different forms and is not limited to the embodiments described herein.

Hereinafter, embodiments of the disclosure will be described in detail with reference to the drawings.

FIG. 1 is a block diagram of an aerosol generating device 100 according to an embodiment.

The aerosol generating device 100 may include a controller 110, a sensing unit 120, an output unit 130, a battery 140, a heater 150, a user input unit 160, a memory 170, and a communication unit 180. However, an internal structure of the aerosol generating device 100 is not limited to what is shown in FIG. 1. It is to be understood by one of ordinary skill in the art to which the disclosure pertains that some of the components shown in FIG. 1 may be omitted or new components may be added according to the design of the aerosol generating device 100.

The sensing unit 120 may sense a state of the aerosol generating device 100 or a state of an environment around the aerosol generating device 100, and transmit sensing information obtained through the sensing to the controller 110. Based on the sensing information, the controller 110 may control the aerosol generating device 100 to control operations of the heater 150, restrict smoking, determine whether an aerosol generating article (e.g., an aerosol generating article, a cartridge, etc.) is inserted, display a notification, and perform other functions.

The sensing unit 120 may include at least one of a temperature sensor 122, an insertion detection sensor 124, or a puff sensor 126. However, embodiments are not limited thereto.

The temperature sensor 122 may sense a temperature at which the heater 150 (or an aerosol generating material) is heated. The aerosol generating device 100 may include a separate temperature sensor for sensing the temperature of the heater 150, or the heater 150 itself may also function as a temperature sensor. Alternatively, the temperature sensor 122 may be arranged around the battery 140 to monitor the temperature of the battery 140.

The insertion detection sensor 124 may sense whether the aerosol generating article is inserted and/or removed. The insertion detection sensor 124 may include, for example, at least one of a film sensor, a pressure sensor, a light sensor, a resistive sensor, a capacitive sensor, an inductive sensor, or an infrared sensor, which may sense a signal change by the insertion and/or removal of the aerosol generating article.

The puff sensor 126 may sense a puff from a user based on various physical changes in an airflow path or airflow channel. For example, the puff sensor 126 may sense the puff from the user based on any one of a temperature change, a flow change, a voltage change, and a pressure change.

The sensing unit 120 may further include at least one of a temperature/humidity sensor, an atmospheric pressure sensor, a magnetic sensor, an acceleration sensor, a gyroscope sensor, a position sensor (e.g., a global positioning system (GPS)), a proximity sensor, or a red, green, blue (RGB) sensor (e.g., an illuminance sensor), in addition to the sensors 122 through 126 described above. A function of each sensor may be intuitively inferable from its name by one of ordinary skill in the art, and thus, a more detailed description thereof will be omitted here.

The output unit 130 may output information about the state of the aerosol generating device 100 and provide the information to the user. The output unit 130 may include at least one of a display 132, a haptic portion 134, or a sound outputter 136. However, embodiments are not limited thereto. When the display 132 and a touchpad are provided in a layered structure to form a touchscreen, the display 132 may be used as an input device in addition to an output device.

The display 132 may visually provide information about the aerosol generating device 100 to the user. The information about the aerosol generating device 100 may include, for example, a charging/discharging state of the battery 140 of the aerosol generating device 100, a preheating state of the heater 150, an insertion/removal state of the aerosol generating article, a limited usage state (e.g., an abnormal article detected) of the aerosol generating device 100, or the like, and the display 132 may externally output the information. The display 132 may be, for example, a liquid-crystal display panel (LCD), an organic light-emitting display panel (OLED), or the like. The display 132 may also be in the form of a light-emitting diode (LED) device.

The haptic portion 134 may provide information about the aerosol generating device 100 to the user in a haptic way by converting an electrical signal into a mechanical stimulus or an electrical stimulus. The haptic portion 134 may include, for example, a motor, a piezoelectric element, or an electrical stimulation device.

The sound outputter 136 may provide information about the aerosol generating device 100 to the user in an auditory way. For example, the sound outputter 136 may convert an electric signal into a sound signal and externally output the sound signal.

The battery 140 may supply power to be used to operate the aerosol generating device 100. The battery 140 may supply power to heat the heater 150. In addition, the battery 140 may supply power required for operations of the other components (e.g., the sensing unit 120, the output unit 130, the user input unit 160, the memory 170, and the communication unit 180) included in the aerosol generating device 100. The battery 140 may be a rechargeable battery or a disposable battery. The battery 140 may be, for example, a lithium polymer (LiPoly) battery. However, embodiments are not limited thereto.

The heater 150 may receive power from the battery 140 to heat the aerosol generating material. Although not shown in FIG. 1, the aerosol generating device 100 may further include a power conversion circuit (e.g., a direct current (DC)-to-DC (DC/DC) converter) that converts power of the battery 140 and supplies the power to the heater 150. In addition, when the aerosol generating device 100 generates an aerosol by induction heating, the aerosol generating device 100 may further include a DC-to-alternating current (AC) (DC/AC) converter that converts DC power of the battery 140 into AC power.

The controller 110, the sensing unit 120, the output unit 130, the user input unit 160, the memory 170, and the communication unit 180 may receive power from the battery 140 to perform functions. Although not shown in FIG. 1, the aerosol generating device 100 may further include a power conversion circuit, for example, a low dropout (LDO) circuit or a voltage regulator circuit, which converts power of the battery 140 and supplies the power to respective components.

In an embodiment, the heater 150 may be formed of a predetermined electrically resistive material that is suitable. For example, the electrically resistive material may be a metal or a metal alloy including, for example, titanium, zirconium, tantalum, platinum, nickel, cobalt, chromium, hafnium, niobium, molybdenum, tungsten, tin, gallium, manganese, iron, copper, stainless steel, nichrome, or the like. However, embodiments are not limited thereto. In addition, the heater 150 may be implemented as a metal heating wire, a metal heating plate on which an electrically conductive track is arranged, a ceramic heating element, or the like, but is not limited thereto.

In another embodiment, the heater 150 may be an induction heater. For example, the heater 150 may include a susceptor that heats the aerosol generating material by generating heat through a magnetic field applied by a coil.

In an embodiment, the heater 150 may include a plurality of heaters. For example, the heater 150 may include a first heater for heating the aerosol generating article and a second heater for heating a liquid.

The user input unit 160 may receive information input from the user or may output information to the user. For example, the user input unit 160 may include a keypad, a dome switch, a touchpad (e.g., a contact capacitive type, a pressure resistive film type, an infrared sensing type, a surface ultrasonic conduction type, an integral tension measurement type, a piezo effect method, etc.), a jog wheel, a jog switch, or the like. However, embodiments are not limited thereto. In addition, although not shown in FIG. 1, the aerosol generating device 100 may further include a connection interface such as a universal serial bus (USB) interface, and may be connected to another external device through the connection interface such as a USB interface to transmit and receive information or to charge the battery 140.

The memory 170, which is hardware for storing various pieces of data processed in the aerosol generating device 100, may store data processed by the controller 110 and data to be processed by the controller 110. The memory 170 may include at least one type of storage medium of a flash memory type memory, a hard disk type memory, a multimedia card micro type memory, a card type memory (e.g., an SD or XD memory), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk. The memory 170 may store an operating time of the aerosol generating device 100, a maximum number of puffs, a current number of puffs, at least one temperature profile, data associated with a smoking pattern of the user, or the like.

The communication unit 180 may include at least one component for communicating with another electronic device. For example, the communication unit 180 may include a short-range wireless communication unit 182 and a wireless communication unit 184.

The short-range wireless communication unit 182 may include a Bluetooth communication unit, a Bluetooth low energy (BLE) communication unit, a near field communication unit, a wireless area network (WLAN) (wireless fidelity (Wi-Fi)) communication unit, a ZigBee communication unit, an infrared data association (IrDA) communication unit, a Wi-Fi direct (WFD) communication unit, an ultra-wideband (UWB) communication unit, and an Ant+ communication unit. However, embodiments are not limited thereto.

The wireless communicator 184 may include, for example, a cellular network communication unit, an Internet communication unit, a computer network (e.g., a local area network (LAN) or a wide-area network (WAN)) communication unit, or the like. However, embodiments are not limited thereto. The wireless communication unit 184 may use subscriber information (e.g., international mobile subscriber identity (IMSI)) to identify and authenticate the aerosol generating device 100 in a communication network.

The controller 110 may control the overall operation of the aerosol generating device 100. In an embodiment, the controller 110 may include at least one processor. The processor may be implemented as an array of a plurality of logic gates, or may be implemented as a combination of a general-purpose microprocessor and a memory in which a program executable by the microprocessor is stored. In addition, it is to be understood by one of ordinary skill in the art to which the disclosure pertains that the processor may be implemented in other types of hardware.

The controller 110 may control the temperature of the heater 150 by controlling supply of power from the battery 140 to the heater 150. For example, the controller 110 may control the supply of power by controlling switching of a switching element between the battery 140 and the heater 150. As another example, a direct heating circuit may control the supply of power to the heater 150 according to a control command from the controller 110.

The controller 110 may analyze a sensing result obtained by the sensing of the sensing unit 120 and control processes to be performed thereafter. For example, the controller 110 may control power to be supplied to the heater 150 to start or end an operation of the heater 150 based on the sensing result obtained by the sensing unit 120. As another example, the controller 110 may control an amount of power to be supplied to the heater 150 and a time for which the power is to be supplied, such that the heater 150 may be heated up to a predetermined temperature or maintained at a desired temperature, based on the sensing result obtained by the sensing unit 120.

The controller 110 may control the output unit 130 based on the sensing result obtained by the sensing unit 120. For example, when the number of puffs counted through the puff sensor 126 reaches a preset number, the controller 110 may inform the user that the aerosol generating device 100 is to be ended soon, through at least one of the display 132, the haptic portion 134, or the sound outputter 136.

In an embodiment, the controller 110 may control a power supply time and/or a power supply amount for the heater 150 according to a state of the aerosol generating article sensed by the sensing unit 120. For example, when the aerosol generating article is in an over-humidified state, the controller 110 may control the power supply time for an inductive coil to increase a preheating time, compared to a case where the aerosol generating article is in a general state.

An embodiment may also be implemented in the form of a recording medium including instructions executable by a computer, such as a program module executable by the computer. A computer-readable medium may be any available medium that may be accessed by a computer and includes a volatile medium, a non-volatile medium, a removable medium, and a non-removable medium. In addition, the computer-readable medium may include both a computer storage medium and a communication medium. The computer storage medium includes all of a volatile medium, a non-volatile medium, a removable medium, and a non-removable medium implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer medium.

FIG. 2 is a schematic diagram of an aerosol generating module 200 according to an embodiment.

The aerosol generating module 200 according to an embodiment may be accommodated in an aerosol generating device (e.g., the aerosol generating device 100 of FIG. 1) and generate an aerosol. The aerosol generating module 200 according to an embodiment may include a heating unit 220 and an atomizing unit 240 to generate the aerosol. A temperature of the heating unit 220 according to an embodiment may rise to heat an aerosol forming substrate to generate the aerosol. The atomizing unit 240 according to an embodiment may store the aerosol forming substrate and may be disposed adjacent to at least one surface of the heating unit 220 and receive the heat generated in the heating unit 220 through conduction, convection, and/or radiation such that the aerosol may be generated. As shown in FIG. 3*a*, the atomizing unit 240 according to an embodiment may include a first wall 240*a* disposed adjacent to one surface of the heating unit 220 and a second wall 240*b* disposed opposite to the first wall 240*a*. The heating unit 220 that does not require a battery (e.g., the battery 140 of FIG. 1) is described in further detail below.

FIGS. 3*a* to 3*c* are diagrams schematically illustrating a cross-section of the aerosol generating module 200 of FIG. 2 taken along line X-X'.

Referring to FIGS. 3*a* to 3*c*, the heating unit 220 included in the aerosol generating module 200 according to an embodiment may include a first wall 220*a* and a second wall 220*b*. The second wall 220*b* according to an embodiment may be disposed opposite to the first wall 220*a*, and disposed adjacent to the atomizing unit 240. Thus, the heat generated in the heating unit 220 may be easily transferred to the atomizing unit 240 through conduction, convection, and/or radiation.

The heating unit 220 according to an embodiment may further include a first reservoir 222, a second reservoir 224, a barrier plate 226, and a barrier stick 228.

The first reservoir 222 according to an embodiment may accommodate a first material. The second reservoir 224 according to an embodiment may accommodate a second material. The first material and the second material may be mixed and/or combined with each other to generate heat. Examples of such a chemical reaction in which two or more materials are mixed and/or combined such that heat is generated may include an oxidation-reduction reaction associated with a metal reducing agent/oxidizing agent, a crystallization reaction of a supersaturated solution, an oxidation-reduction reaction of iron and/or an iron compound associated with an activated carbon catalyst, and an aqueous chemical reaction. Desirably, heat may be generated by an aqueous exothermic chemical reaction. More desirably, a temperature inside a closed container may rise to about 300 degrees Celsius through a chemical reaction in which water ($H_2O$) and calcium oxide (CaO) react to form calcium hydroxide ($Ca(OH)_2$). The heating unit 220 according to an embodiment may include more reservoirs in addition to the first reservoir 222 and the second reservoir 224, and materials included in the reservoirs may be mixed to generate heat.

The barrier plate 226 according to an embodiment may be disposed between the first reservoir 222 and the second reservoir 224. In addition, the barrier plate 226 according to an embodiment may be formed of an impermeable material so that the first material accommodated in the first reservoir 222 and the second material accommodated in the second reservoir 224 from being mixed through the barrier plate 226. The barrier plate 226 according to an embodiment may be formed of a material with high rigidity. However, embodiments are not limited thereto, and the barrier plate 226 may be formed of a flexible material such as a membrane or a film.

Continuing to refer to FIGS. 3*a* to 3*c*, the barrier stick 228 according to an embodiment may penetrate between the first wall 220*a* and the second wall 220*b* of the heating unit 220 and move in a direction (refer to a direction indicated by an arrow shown in FIG. 3*a*) perpendicular to the first wall 220*a* and/or the second wall 220*b*.

Referring to FIG. 3*b*, one end of the barrier stick 228 according to an embodiment may move farther than a distance from the first wall 220*a* or the second wall 220*b* of the heating unit 220 to the barrier plate 226. In addition, the barrier stick 228 according to an embodiment may move in a direction from the first wall 220*a* toward the second wall 220*b* of the heating unit 220 or move in a direction from the second wall 220*a* toward the first wall 220*a*. When the barrier stick 228 according to an embodiment moves as described above, a through-hole 230 that was blocked by the barrier stick 228 in FIG. 3*a* may be exposed on the barrier plate 226. A diameter of the through-hole 230 according to an embodiment may correspond to, and desirably be the substantially same as, a diameter of the barrier stick 228. When the barrier stick 228 according to an embodiment moves at least a predetermined distance in the direction perpendicular to the first wall 220*a* and/or the second wall 220*b*, the first material accommodated in the first reservoir 222 and the second material accommodated in the second reservoir 224 may be mixed through the through-hole 230 (refer to arrows shown in FIG. 3*b*).

Referring to FIG. 3*c*, when the first material accommodated in the first reservoir 222 and the second material accommodated in the second reservoir 224 are mixed through the through-hole 230, heat may be generated by a chemical reaction between the first material and the second material. According to an embodiment, the second wall 220*b* of the heating unit 220 and the first wall 240*a* of the atomizing unit 240 are disposed adjacent to each other, and thus an aerosol forming substrate accommodated in the atomizing unit 240 may be heated by heat exchange between the two walls 220*b* and 240*a* (refer to arrows H shown in FIG. 3*c*). According to an embodiment, in order to enable the heating unit 220 and the atomizing unit 240 to actively exchange heat, the heating unit 220 and the atomizing unit 240 may desirably be formed of a material with high thermal conductivity. When the atomizing unit 240 is heated by the heating unit 220, the aerosol forming substrate accommodated in the atomizing unit 240 is atomized, and thus an aerosol is generated. The generated aerosol may be discharged to the outside of the atomizing unit 240 (refer to arrows A shown in FIG. 3*c*). The atomizing unit 240 may discharge the aerosol from at least one of its surfaces except for a surface adjacent to the heating unit 220 to smoothly discharge the aerosol to the outside of the aerosol generating module 200. For example, referring to FIG. 3*c*, since the first wall 240*a* of the atomizing unit 240 is disposed adjacent to the first wall 220*a* of the heating unit 220, the aerosol may be discharged through the second wall 240*b* and/or side walls except for the first wall 240*a* of the atomizing unit 240.

FIG. 4 is a diagram schematically illustrating a cross-section of the aerosol generating module 200 according to another embodiment.

In the aerosol generating module 200 according to another embodiment, the barrier plate 226 and the barrier stick 228 may be integrally formed. The barrier plate 226 may be formed of a material having less tensile strength than the barrier stick 228. According to the present embodiment, as the barrier stick 228 moves in a direction perpendicular to the first wall 220*a* and/or the second wall 220*b* of the heating unit 220, the barrier plate 226 may stretch to a predetermined extent and may be torn, broken, or ruptured when the tension exceeds a certain threshold. When the barrier plate 226 is torn, broken, or ruptured, a boundary between the first reservoir 222 and the second reservoir 224 may collapse, and thus the first material accommodated in the first reservoir 222 and the second material accommodated in the second reservoir 224 may be mixed. The mixed first material and the second material may generate heat by a chemical reaction between them, and the generated heat may be transferred to the atomizing unit 240 through conduction, convection, and/or radiation (refer to arrows H shown in FIG. 4). When the heat generated by the heating unit 220 is transferred to the atomizing unit 240, an aerosol forming substrate accommodated in the atomizing unit 240 is atomized, and an aerosol is generated. The generated aerosol may be discharged to the outside of the atomizing unit 240 (refer to the arrows A shown in FIG. 4).

FIG. 5 is a diagram schematically illustrating a cross-section of an aerosol generating device (e.g., the aerosol generating device 100 of FIG. 1) according to an embodiment.

The aerosol generating device 100 according to an embodiment may include the aerosol generating module 200, a housing 300, a mouthpiece 400, and a push unit 500.

Referring to FIG. 5, the aerosol generating module 200 and the push unit 500 according to an embodiment may be included in the housing 300. The mouthpiece 400 according to an embodiment may be disposed adjacent to an end of the housing 300 and may guide an aerosol generated in the aerosol generating module 200 to a mouth of a user.

According to an embodiment, the aerosol generating module 200 included in the housing 300 of the aerosol generating device 100 may include all or part of the above-mentioned characteristics of the aerosol generating module 200.

According to an embodiment, the push unit 500 may be fixed to an interior of the housing 300 of the aerosol generating device 100. When the aerosol generating module 200 is accommodated in the housing 300 of the aerosol generating device 100, the barrier stick 228 may be pushed automatically or manually in a direction perpendicular to the first wall 220*a* and/or the second wall 220*b* of the heating unit 220. The push unit 500 according to an embodiment may include a protrusion 520 and a support portion 540. The protrusion 520 according to an embodiment is a portion that substantially contacts and pushes the barrier stick 228, and the protrusion 520 may be formed of a material that is stronger than the support portion 540. A diameter of the protrusion 520 according to an embodiment may be smaller than a diameter of the barrier stick 228. According to the above description, since the diameter of the barrier stick 228 corresponds to a diameter of the through-hole 230 of the barrier plate 226, the diameter of the protrusion 520 may be smaller than the diameter of the through-hole 230. Since the diameter of the protrusion 520 according to an embodiment is smaller than the diameter of the through-hole 230, when the push unit 500 pushes the barrier stick 228 to separate an end of the barrier stick 228 from the barrier plate 226, a first material and a second material may be mixed through a space between the through-hole 230 and the protrusion 520.

According to another embodiment, the push unit 500 may be hidden in the housing 300 of the aerosol generating device 100 and may be exposed on a surface in the housing by a user input to push the barrier stick 228. In this case, even when the aerosol generating module 200 is included in the housing 300, heating may not start when not desired by the user. When the user provides a predetermined input at a desired point in time through a user input unit (e.g., the user input unit 160 of FIG. 1), the push unit moves to push the barrier stick 228 of the aerosol generating module 200 and causes the heating unit 220 to start heating.

Continuing to refer to FIG. 5, an aerosol generated in the aerosol generating module 200 may move to the mouthpiece 400 along an inner wall of the housing 300 (refer to an aerosol airflow path P shown in FIG. 5). That is, the aerosol airflow path is formed in the housing 300 to guide the aerosol to the mouthpiece 400. When the aerosol moves along the airflow path P in the aerosol generating device 100 according to an embodiment, the heating unit 220 may keep heating the atomizing unit 240 continuously, and accordingly the aerosol may be continuously generated until an aerosol forming substrate accommodated in the atomizing unit 240 is depleted.

Continuing to refer to FIG. 5, the atomizing unit 240 may discharge the aerosol from an atomizing surface that is at least one of its surfaces except for a surface adjacent to the heating unit 220 to allow the aerosol to smoothly move through the airflow path P. For example, referring to FIG. 3, since the first wall 240*a* of the atomizing unit 240 is disposed adjacent to the first wall 220*a* of the heating unit 220, the aerosol may be discharged through the second wall 240*b* and/or side walls except for the first wall 240*a* of the atomizing unit 240. That is, the atomizing surface may be at least a surface of the second wall 240*b* and/or the side walls of the atomizing unit 240. The atomizing surface according to an embodiment may be formed in a mesh type through which the aerosol may smoothly pass.

FIG. 6 is a diagram schematically illustrating a cross-section of an aerosol generating device (e.g., the aerosol generating device 100 of FIG. 1) according to another embodiment.

In an embodiment, when heat is generated as a first material and a second material are mixed in the heating unit 220, the heat may be emitted from other surfaces as well as the first wall 220*a* of the heating unit 220. As an area in which the heating unit 220 and atomizing unit 240 are disposed adjacently increases, thermal efficiency may increase. Referring to FIG. 6, the heating unit 220 may further include a side wall formed between the first wall 220*a* and the second wall 220*b* (refer to FIG. 3*a*), the atomizing unit 240 may be disposed adjacent to at least a portion of the second wall 220*b* and the side walls as well as the first wall 220*a* of the heating unit 220, and accordingly an aerosol forming substrate accommodated in the atomizing unit 240 may be heated more efficiently by heat emitted from the heating unit 220.

Although the embodiments have been described with reference to the limited drawings, one of ordinary skill in the art may apply various technical modifications and variations based thereon. For example, suitable results may be achieved if the described techniques are performed in a different order and/or if components in a described system, architecture, device, or circuit are combined in a different manner or replaced or supplemented by other components or their equivalents.

Therefore, other implementations, other embodiments, and equivalents of the claims are within the scope of the following claims.

The invention claimed is:

1. An aerosol generating module, comprising:
a heating unit; and
an atomizing unit disposed adjacent to the heating unit and comprising an aerosol forming substrate,
wherein the heating unit comprises:
a first reservoir comprising a first material;
a second reservoir comprising a second material that generates heat by reacting with the first material;
a barrier plate disposed between the first reservoir and the second reservoir and formed of an impermeable material;
a first wall;
a second wall disposed opposite to the first wall and disposed adjacent to the atomizing unit; and
a barrier stick penetrating between the first wall and the second wall of the heating unit,
wherein the barrier plate comprises a through-hole having a diameter corresponding to a diameter of the barrier stick;
wherein when the barrier stick moves from the second wall toward the first wall, the first material and the second material are mixed, and
wherein the aerosol forming substrate is heated by heat generated by the mixed first material and second material.

2. The aerosol generating module of claim 1, wherein
the barrier stick is movable in a direction perpendicular to the first wall of the heating unit.

3. The aerosol generating module of claim 1, wherein
the barrier plate and the barrier stick are integrally formed, and the barrier plate is formed of a material having less tensile strength than the barrier stick, and
when the barrier stick moves from the second wall toward the first wall, the barrier plate is ruptured such that the first material and the second material are mixed.

4. The aerosol generating module of claim 1, wherein the atomizing unit is configured to discharge an aerosol from at least one of surfaces except for a surface adjacent to the heating unit.

5. An aerosol generating device, comprising:
a housing;
a mouthpiece formed at one end of the housing; and
an aerosol generating module comprised in the housing,
wherein the aerosol generating module comprises:
an atomizing unit configured to store an aerosol forming substrate; and
a heating unit disposed adjacent to the atomizing unit and configured to heat the aerosol forming substrate,
wherein the heating unit comprises:
a first reservoir comprising a first material;
a second reservoir comprising a second material that generates heat by reacting with the first material;
a barrier plate disposed between the first reservoir and the second reservoir and formed of an impermeable material;
a first wall faces the mouthpiece;
a second wall disposed opposite to the first wall; and
a barrier stick penetrating between the first wall and the second wall of the heating unit,
wherein the barrier plate comprises a through-hole having a diameter corresponding to a diameter of the barrier stick;
wherein when the barrier stick moves from the second wall toward the first wall, the first material and the second material are mixed,
the aerosol generating device further comprises a push unit configured to push the barrier stick,
when the aerosol generating module is inserted into the housing, the push unit pushes the barrier stick from the second wall toward the first wall, and thus, the first material and the second material are mixed through the through-hole, and wherein the aerosol forming substrate is heated by heat generated by the mixed first material and second material.

6. The aerosol generating device of claim 5, wherein a diameter of the push unit is smaller than a diameter of the through-hole.

7. The aerosol generating device of claim 5, wherein the barrier plate is formed of a material having less tensile strength than the barrier stick, and the barrier plate and the barrier stick are integrally formed, and when the aerosol generating module is inserted into the housing, the push unit pushes the barrier stick from the second wall toward the first wall such that the barrier plate is ruptured and the first material and the second material are mixed.

8. The aerosol generating device of claim 5, wherein the push unit is exposed from one surface of an interior of the housing by a user input.

9. The aerosol generating device of claim 5, wherein the atomizing unit is configured to discharge an aerosol through an atomizing surface including at least one of surfaces except for a surface disposed adjacent to the heating unit, and an airflow path is formed along an inner wall of the housing to guide the aerosol generated in the atomizing unit to the mouthpiece.

10. The aerosol generating device of claim 9, wherein the atomizing surface is formed in a mesh type through which the generated aerosol is able to pass.

11. The aerosol generating device of claim 5, wherein the heating unit further comprises a side wall formed between the first wall and the second wall, and the atomizing unit is disposed adjacent to at least a portion of the second wall and the side wall.

* * * * *